US009437066B2

(12) United States Patent
String

(10) Patent No.: US 9,437,066 B2
(45) Date of Patent: Sep. 6, 2016

(54) COIN WRAPPER SHEET

(71) Applicant: GCCM, LLC, Harrisburg, PA (US)

(72) Inventor: Gregory F. String, Mechanicsburg, PA (US)

(73) Assignee: GCCM, LLC, Harrisburg, PA (US)

( * ) Notice: Subject to any disclaimer, the term of this patent is extended or adjusted under 35 U.S.C. 154(b) by 0 days.

(21) Appl. No.: 14/519,193

(22) Filed: Oct. 21, 2014

(65) Prior Publication Data

US 2016/0035169 A1 Feb. 4, 2016

Related U.S. Application Data

(60) Provisional application No. 61/898,098, filed on Oct. 31, 2013.

(51) Int. Cl.

| | |
|---|---|
| ***B65D 65/04*** | (2006.01) |
| ***G07D 9/00*** | (2006.01) |
| ***B65B 11/56*** | (2006.01) |
| ***B65B 51/02*** | (2006.01) |

(52) U.S. Cl.

CPC ..... *G07D 9/006* (2013.01); *B65B 11/56* (2013.01); *B65B 51/02* (2013.01)

(58) Field of Classification Search

CPC .. G07D 9/006; B65D 75/5833; B65D 75/06; B65D 75/04; B65D 75/52; B65D 75/58

USPC ..... 229/87.2, 87.01, 87.05, 87.08, 89

See application file for complete search history.

(56) References Cited

U.S. PATENT DOCUMENTS

| | | | | |
|---|---|---|---|---|
| 190,903 | A * | 5/1877 | Rettig | 229/87.2 |
| 779,155 | A * | 1/1905 | Gearing | 229/87.2 |
| 3,967,435 | A | 7/1976 | Bergmaier | |
| 4,383,541 | A | 5/1983 | Uchida | |
| 4,409,773 | A | 10/1983 | Bergman et al. | |
| 4,515,172 | A | 5/1985 | Nakamura et al. | |
| 4,546,875 | A * | 10/1985 | Zweber | 206/0.82 |
| 4,718,218 | A | 1/1988 | Ristvedt | |
| 4,911,685 | A * | 3/1990 | Hucks | 493/264 |
| 5,022,890 | A | 6/1991 | Rapp | |
| 5,389,034 | A | 2/1995 | Rumbach | |
| 5,487,252 | A | 1/1996 | Ozeki et al. | |
| 5,540,031 | A | 7/1996 | Ozeki et al. | |
| 6,499,277 | B1 | 12/2002 | Warner et al. | |
| 6,519,921 | B1 | 2/2003 | Tsuruda et al. | |
| 7,470,175 | B2 | 12/2008 | Sugahara et al. | |

FOREIGN PATENT DOCUMENTS

| | | | |
|---|---|---|---|
| CA | 2418438 | A1 | 6/2004 |
| JP | 01070317 | A * | 3/1989 |
| SU | 975502 | A1 | 11/1982 |
| WO | 2012037473 | A2 | 3/2012 |

OTHER PUBLICATIONS

ISR/RU, International Search Report in corresponding PCT/US2015/056302, May 12, 2016, seven pages.

* cited by examiner

*Primary Examiner* — Jes F Pascua

(74) *Attorney, Agent, or Firm* — Hooker & Habib, P.C.

(57) ABSTRACT

An improved coin wrapper sheet for machine or hand wrapping a stack of like-diameter coins includes one or more tabs that can be easily gripped and pulled by the user to open the coin wrapper and release the coins.

15 Claims, 3 Drawing Sheets

COIN WRAPPER SHEET

This application claims priority from my U.S. Provisional Patent Application No. 61/898,098 for "Coin Wrapper Sheet for Machine-Wrapped Coins" filed Oct. 31, 2013, which priority application is incorporated by reference as if fully set forth herein.

FIELD OF THE DISCLOSURE

The disclosure relates to the wrapping of coins with a coin wrapper sheet.

BACKGROUND OF THE DISCLOSURE

Coin wrapping machines wrap stacks of like-diameter coins with coin wrapper sheets and secure the wrapped sheets around the coin stack without the use of adhesives or glues. An example of a coin wrapping machine that machine-wraps coin stacks is disclosed in Tsuruda et al U.S. Pat. No. 6,519,921.

Coins are formed into a stack. Paper is fed off a roll to the coin wrapping machine. Before being wrapped around the coin stack, a length of paper is cut from the roll to form a coin wrapper sheet. The coin wrapper sheet is fed into the coin wrapping machine and is tightly wrapped around the coin stack. The upper and lower ends of the wrapped sheet are crimped by crimp claws to mechanically secure the wrapped sheet without the use of adhesives or glues.

FIG. 1 illustrates a typical coin wrapper sheet 110 cut from the paper roll. The coin wrapper sheet is cut using a "V" shaped cutter that forms a "V" shaped leading end 112 and a corresponding "V" shaped trailing end 114 in the sheet 110. The point of the leading end "V" precedes the rest of the sheet into the coin wrapping machine, and the essentially straight surface edges or legs 116, 118 of the trailing "V" end 114 trail the rest of the sheet into the coin wrapping machine. The coin wrapper sheet typically includes printed indicia indicating coin denomination, manufacturer information and/or trademark, and the like.

Typically fifty-pound weight kraft paper is used for wrapping US quarter-dollar coins and larger diameter coins, and forty-pound weight kraft paper is used for wrapping smaller diameter coins. Coin wrapper sheets can be formed however from any suitable planar or sheet material including plastic films, other types of paper sheets, and the like.

After wrapping and crimping, the coin wrapper sheet 110 is tightly wrapped around the coin stack to form a cylindrical tube 120 surrounding the coin stack. FIG. 2 illustrates the sheet 110 wrapped around a coin stack to form the cylindrical tube 120, the opposite ends of the tube 120 being crimped in a conventional manner.

The tube 120 extends along a longitudinal axis 122 that coincides with the longitudinal axis of the coin stack. The sheet 110 is wrapped in a wrapping direction around the axis 122. The leading end portion of the sheet 110 is overwrapped by the trailing end portion of the sheet. The trailing "V" end 114 of the sheet 110 and the trailing legs 116, 118 are on the upper surface of the tube 120 and overlay a lower sheet surface of the tube 120.

The upper and lower ends of the wrapped sheet 110, including the trailing ends of the legs 116, 118, are crimped over the ends of the coin stack to resist unwrapping of the tube 120 and to prevent the coins from falling out of the open ends of the tube 120. The crimped portions of the wrapped sheet 110 extend around the tube axis 122.

The legs 116, 118 extend continuously from end points 124, 126 at respective crimped ends of the wrapped sheet 110 around the tube axis 122 in the direction opposite the wrapping direction to a common end point 128 at the tip of the trailing "V" 114 at the axial midpoint of the coin stack. That is, the tip 128 of the trailing "V" 114 is displaced opposite the wrapping direction some angular distance from a straight line joining the points 124, 126.

Wrapping and crimping the sheet 110 urges the trailing sheet end taut against and around the coin stack. Each leg 116, 118 is placed in tension from the respective crimp points 124, 126 to the common end point 128. The tension urges the uppermost exposed sheet portion against the coin stack and keeps the uppermost exposed sheet portion taut against the coin stack.

The tightly wrapped and crimped tube 120 is difficult to open to release the coins. It is difficult for a person to pry the trailing sheet end 114 away from the coin stack when attempting to break or tear the coin wrapper sheet 110 to release the coins from the tube 120.

Many persons strike the middle of the coin stack against an edge of a cash register or till to break the coin wrapper sheet 110 and release the coins into the register or till. The impact of the coin stack may, however, cause damage.

Other persons use the tip of a knife or other cutting blade to cut through the coin wrapper sheet 110.

Yet other persons use their fingers to attempt pulling on the trailing end 114 and thereby unwrapping the coin wrapper sheet 110. The "V"-shaped wrapper trailing end 114 is tightly stretched against the coin stack. The crimped upper and lower sheet ends resist attempts to raise the trailing end 114 away from the coin stack. It is often difficult to obtain sufficient purchase to tear open the coin wrapper sheet 110 by pulling on the sheet end 114.

SUMMARY OF THE DISCLOSURE

Disclosed is an improved coin wrapper sheet for machine or hand wrapping a stack of like-diameter coins, and a wrapped stack of like-diameter coins using the coin wrapper sheet. The coin wrapper sheet can be a sheet of kraft paper or the like used for forming conventional coin wrapper sheets.

The disclosed coin wrapper sheet is a flat sheet that includes a leading portion at a leading edge of the sheet and a trailing portion at a trailing edge of the sheet. When wrapped around the coin stack, the trailing portion of the sheet overlies the leading portion of the sheet.

A portion of the trailing edge of the sheet defines a tab that extends away from the leading edge of the sheet. When the sheet is wrapped around the coin stack, the tab overlies overlying the coin stack and extends in the wrapping direction away from the remaining portion of the trailing edge of the sheet. This enables a user to grip the tab and pull the tab to open the coin wrapper and release the coins.

Other objects and features of the disclosure will become apparent as the description proceeds, especially when taken in conjunction with the accompanying drawing sheets illustrating one or more non-limiting embodiments.

DETAILED DESCRIPTION

Figure 1:
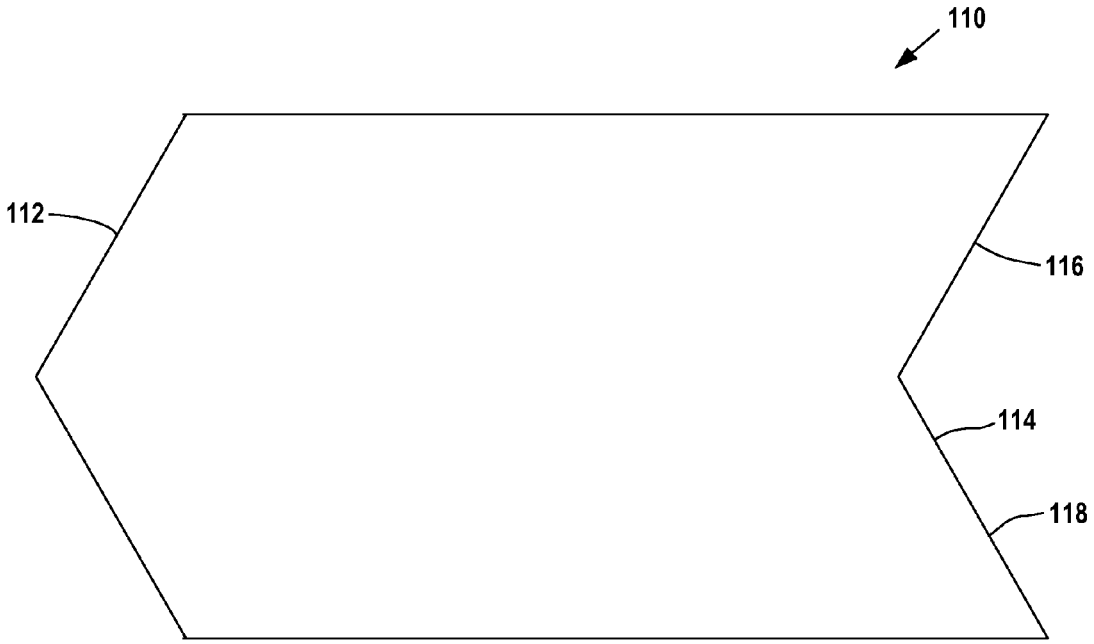
FIG. 1 PRIOR ART
FIG. 1 is a developed view of a conventional coin wrapper sheet.
Figure 3:
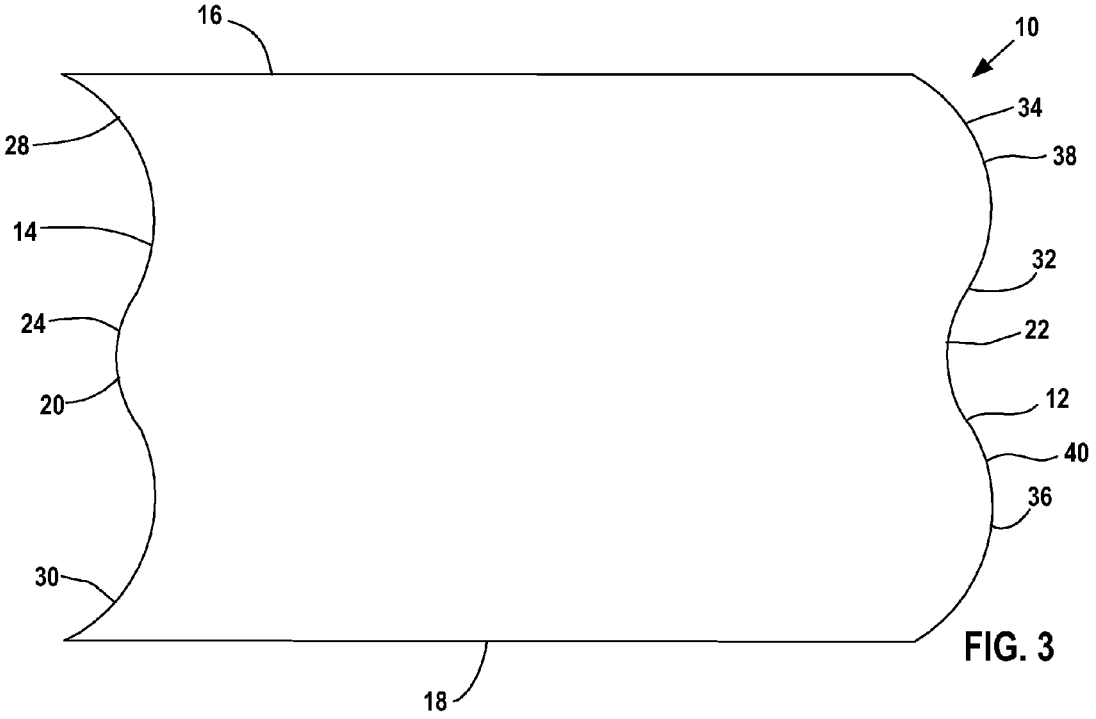
FIG. 3 is a developed view of a first embodiment coin wrapper sheet.

FIG. 3 is a developed view of an embodiment 10 of an improved coin wrapper sheet. The sheet 10 is shown flat prior to being wrapped around a coin stack. The sheet 10 may be die-cut or knife-cut from a sheet roll being fed to a coin-wrapping machine (not shown) in which each cut defines a leading end or edge 12 of a trailing sheet 10 and a trailing end or edge 14 of an adjacent leading sheet 10. The leading end 12 and the trailing end 14 are separated by the length dimension of the sheet. An upper sheet side 16 and a lower sheet side 18 are separated by the width dimension of the sheet and extend the length of the sheet.

The ends 12, 14 are cut to a shape in which a portion of the trailing sheet end 14 defines a tab portion 20 that protrudes away from the remaining portion of the trailing sheet end and a portion of the leading edge 12 defines a corresponding indent portion 22 that extends into the remaining portion of the leading sheet end. The tab 20 is centered between the sheet sides 16, 18 and has a maximum width about one-third of the width of the sheet 10.

In the illustrated embodiment the leading and trailing sheet ends 12, 14 are defined by an identical, generally "W"-shaped profile or contour instead of the conventional "V" shaped profile or contour. The leading and trailing end profiles being identical allows use of a single cutter to cut the coin wrapper sheets 10 from a supply roll.

The lines forming the "W" profile are rounded along at least portions of the lines and so each line does not extend in a straight line for the entire length of the line.

At the trailing sheet end 14 the "W" cut defines a convex edge 24 centered between the upper and lower sheet sides 16, 18 that defines the tab portion 20. Upper and lower concave edges or legs 28, 30 extend from opposite sides of the convex edge 24 to respective sheet sides 16, 18.

The "W"-shaped cut at the leading end of the sheet forms a concave edge 32 on the leading sheet end 12 corresponding to the convex edge 24 and convex edges or legs 34, 36 corresponding to the concave edges or legs 28, 30.

The concave edges 28, 30 define projecting portions 38, 40 on either side of the indent portion 22 that extend away from the adjacent portions of the sheet. The convex leading sheet portions 38, 40 defined by the convex edges 34, 36 function like the conventional projecting lead end of a conventional wrapper sheet 110 to assist in feeding the sheet 10 into the coin wrapping machine.

Machine wrapping and crimping a stack of like-diameter coins with the coin wrapper sheet 10 is similar to machine wrapping and crimping the same stack of coins with the conventional coin wrapper sheet 110 and so will not be described further.

Figure 4:
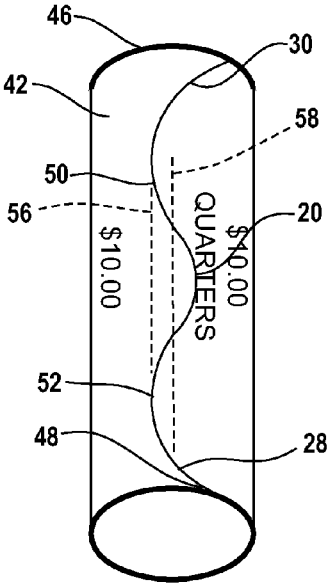
FIG. 4 illustrates the coin wrapper sheet shown in FIG. 3 machine-wrapped and crimped to form a coin tube containing a stack of coins.
Figure 5:
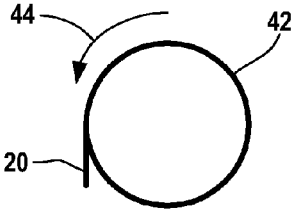
FIG. 5 is an end view of the coin tube shown in FIG. 4.
Figure 2:
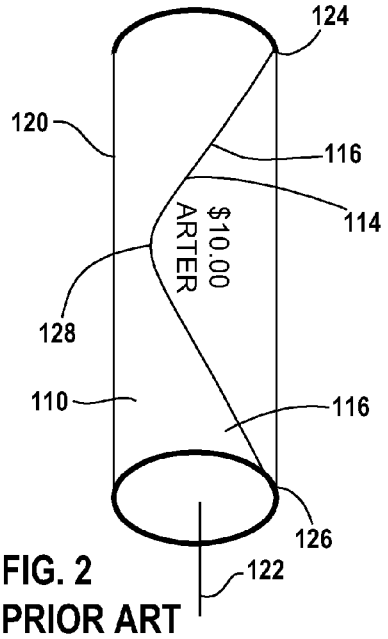
FIG. 2 PRIOR ART
FIG. 2 illustrates the coin wrapper sheet shown in FIG. 1 machine-wrapped and crimped around a stack of coins.

FIGS. 4 and 5 illustrate the coin wrapper sheet machine-wrapped and crimped around a stack of like-diameter coins to form a cylindrical tube 42 surrounding the coin stack. The illustrated wrapped and crimped tube 42 resists unwrapping without adhesives and without additional fasteners, ties, or other mechanical restraints.

During machine wrapping, the sheet 10 is wrapped around the stack of coins in a wrapping direction indicated by the arrow 44. The axially opposite ends of the wrapped sheet 10 are crimped over the opposite ends of the coin stack. The legs 28, 30 extend from end points 46, 48 at respective crimped ends of the wrapped sheet 10 around the tube axis in the direction opposite the wrapping direction 44 to respective ends 50, 52 on opposite sides of the tab 20.

The tab 20 is centered along the coin tube 42 between the longitudinally opposite ends of the coin stack. The tab 20 extends in the wrapping direction some angular distance away from the ends 50, 52 to a free end 54. In the illustrated embodiment the tab 20 extends in the wrapping direction beyond a straight line 56 joining the end points 46, 48 of the legs 28, 30.

The tab 20 is exposed on the outside of the tube 42 and can be folded over a fold line 58 (shown as a dashed line in FIG. 4) without affecting the remainder of the coin tube for gripping by a person attempting to open the coin wrapper. Folding the tab 20 does not generate tension along the legs 28, 30 that would resist folding over the tab 20. The person can readily grip and fold the tab 20 and unwrap the coin wrapper.

FIG. 5 illustrates that the unstressed tab 20 may be designed so that the coin tube 42 can roll on a flat surface without causing the tab 20 to crease and fold back on itself.

The unstressed tab 20 may extend generally tangential to the outer circumference of the tube 42 due to the inherent stiffness of the sheet material. The tab 20 in the illustrated embodiment extends away from the outer circumference of the tube 42 a distance less than the outer radius of the coin tube 42. Rolling of the tube 42 on a flat surface in the wrapping direction 44 as shown in FIG. 5 inclines or tilts the tab 20 to the perpendicular and then beyond the perpendicular such that the leading end of the tab 20 enters the "pinch point" between the roll 42 and the surface and is not folded backwards onto itself.

Figure 6:
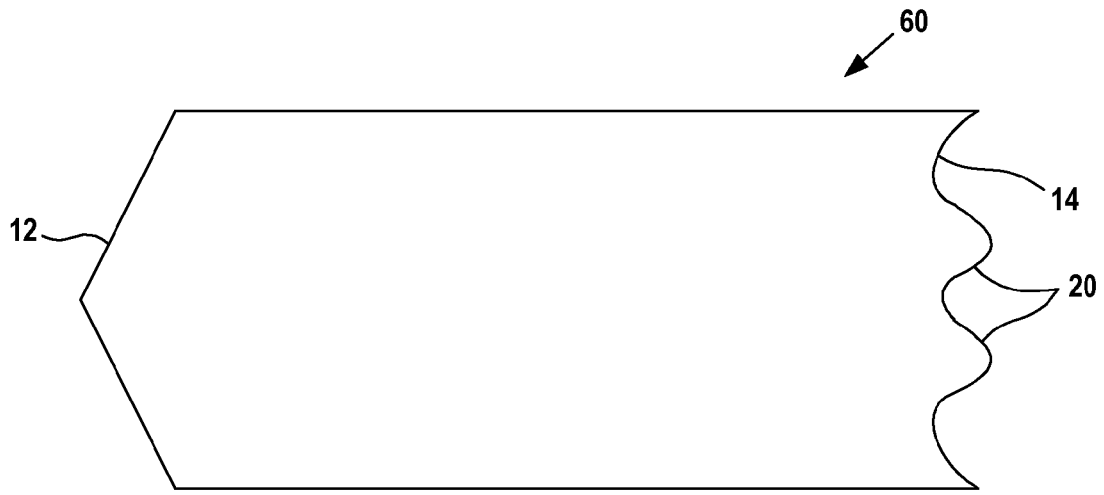
FIG. 6 is a developed view of a second embodiment coin wrapper sheet.

The illustrated coin wrapper sheet 10 has one tab portion 20. Other embodiments of the coin wrapper sheet can be produced with two or more tab portions 20 spaced along the width of the trailing sheet end 14 (as shown in FIG. 6 discussed below).

The tab portion 20 of the illustrated coin wrapper sheet 10 extends in the wrapping direction beyond the straight line 56 joining the trailing crimped sheet ends. Other embodiments of the coin wrapper sheet can be produced with one or more tab portions that do not extend beyond the line joining the crimped sheet ends.

The illustrated coin wrapper sheet 10 is cut from a roll using a single cutter blade that simultaneously cuts the leading end of one sheet and the trailing end of an adjacent sheet. Other embodiments of the coin wrapper sheet can be manufactured with the leading end of the sheet having a profile or contour that does not correspond to the profile or contour of the trailing end of the sheet. For example, FIG. 6 illustrates a second embodiment coin wrapper sheet 60 in which the leading sheet edge 12 defines a conventional "V"-shaped leading sheet end and the trailing edge 14 defines two tabs 20.

Figure 7:
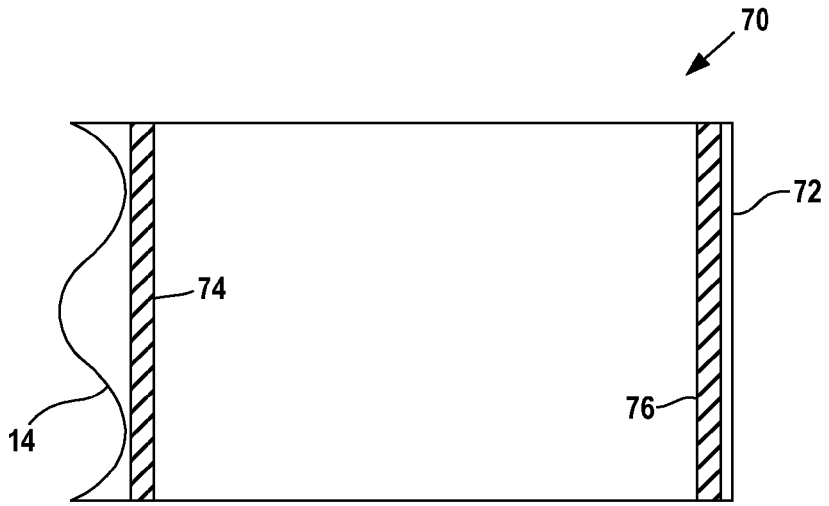
FIG. 7 is a developed view of a third embodiment coin wrapper sheet.

Although the disclosed coin wrapper sheet is useful for the machine wrapping of coins, the coin wrapper sheet can also be used for manually wrapping coins. FIG. 7 illustrates a coin wrapper sheet 70 having a trailing edge 14 similar to the trailing edge 14 of the sheet 10 and a straight leading edge 72. Closely adjacent the edges of the sheet are adhesive strips 74, 76 located on opposite sides of the sheet 70. The coin wrapping sheet 70 is rolled into a cylinder with the adhesive strips 74, overlapping and adhering to one another to maintain the cylindrical shape of the sheet, with the trailing edge 14 on the outside of the cylinder. The ends of the wrapped sheet can be manually crimped using my manual coin crimper disclosed in my U.S. Pat. No. 6,374,573.

While this disclosure includes one or more illustrative embodiments described in detail, it is understood that the one or more embodiments are each capable of modification and that the scope of this disclosure is not limited to the precise details set forth herein but include such modifications that would be obvious to a person of ordinary skill in the relevant art and fall within the purview of the following claims.

What is claimed is:

1. A wrapped stack of like-diameter coins comprising:

a stack of like-diameter coins extending along a longitudinal axis, the coin stack having opposite ends;

a flat sheet wrapped around the stack of coins in a wrapping direction around the longitudinal axis, the wrapped sheet defining a tube surrounding the coin stack;

the tube having first and second crimped ends that overlay the ends of the coin stack, the crimped ends resisting unwrapping of the tube without the assistance of glue or adhesives;

the sheet comprising a leading portion at a leading edge of the sheet and a trailing portion at a trailing edge of the sheet, the trailing portion overlying the leading portion when the sheet is wrapped around the stack of coins;

the trailing portion comprising a first edge portion extending in the wrapping direction and adjacent to the first crimped end of the tube when the sheet is wrapped around the sheet of coins, a second edge portion extending in the wrapping direction and adjacent to the second crimped end of the tube when the sheet is wrapped around the sheet of coins, and an intermediate portion disposed between the first and second edge portions;

the trailing edge along the intermediate portion defining a tab extending in the wrapping direction beyond the first and second edge portions, the tab having spaced-apart first and second points on the trailing edge on opposite sides of the tab and including a third point on the trailing edge between the first and second points, the trailing edge extending in the wrapping direction from the first point to the third point and the trailing edge extending opposite the wrapping direction from the third point to the second point whereby the third point is spaced in the wrapping direction away from both the first point and second points.

2. The wrapped stack of claim 1 wherein the tab is substantially centered between the ends of the coin stack.

3. The wrapped stack of claim 1 wherein the trailing edge along the intermediate portion defines at least one additional tab overlying the stack of coins and extending in the wrapping direction away from the first and second edge portions.

4. The wrapped stack of claim 1 wherein the coin tube has longitudinally opposite ends, the trailing edge comprising an edge subportion extending from each end of the coin tube to the tab, each edge subportion extending from the respective end of the coin tube around the longitudinal axis in a direction opposite the wrapping direction.

5. The wrapped stack of claim 4 wherein each edge subportion extends from a point on the respective edge of the coin tube, the tab extending beyond a line joining the edge points.

6. The wrapped stack of claim 1 wherein the tube has an outer radius dimension, and the third point extends in the wrapping direction from the first and second points a distance less than the outer radius dimension.

7. The wrapped stack of claim 1 wherein the portion of the trailing edge defining the tab is convex.

8. The wrapped stack of claim 1 wherein the leading edge of the sheet and the trailing edge of the sheet have identical profiles.

9. The wrapped stack of claim 1 wherein the trailing edge of the sheet has a generally "W" shaped profile.

10. The wrapped stack of claim 1 wherein the tab is foldable along a fold line without affecting the remainder of the coin tube.

11. The wrapped stack of claim 1 wherein the portion of the trailing edge defining the tab is disposed between a pair of concave trailing edge subportions.

12. The wrapped stack of claim 1 wherein the sheet is kraft paper.

13. The wrapped stack of claim 1 wherein the crimped ends are crimped by crimp claws.

14. The wrapped stack of claim 1 wherein the tab comprises a surface facing the stack of coins, the surface without glues or adhesives.

15. The wrapped stack of claim 1 without glues or adhesives.

* * * * *